US005785416A

United States Patent [19]

Hansen

[11] Patent Number: 5,785,416

[45] Date of Patent: Jul. 28, 1998

[54] LAMP WITH ADJUSTABLE SHADE FOR REGULATION OF BEAM

[76] Inventor: Ivar Hansen, Grinibråten 51, N-1313 Vøyenenga, Norway

[21] Appl. No.: 750,451

[22] PCT Filed: Jun. 9, 1995

[86] PCT No.: PCT/NO95/00097

§ 371 Date: Dec. 6, 1996

§ 102(e) Date: Dec. 6, 1996

[87] PCT Pub. No.: WO95/34782

PCT Pub. Date: Dec. 21, 1995

[30] Foreign Application Priority Data

Jun. 10, 1994 [NO] Norway ..... 942182

[51] Int. Cl.[6] ..... F21V 1/00

[52] U.S. Cl. ..... 362/280; 362/319; 362/360; 362/432

[58] Field of Search ..... 362/187, 188, 362/277, 280, 281, 319, 352, 360, 370, 371, 430, 432

[56] References Cited

U.S. PATENT DOCUMENTS

| | | | |
|---|---|---|---|
| 1,166,930 | 1/1916 | Petrie | 362/280 |
| 1,395,490 | 11/1921 | Graff | 362/277 |
| 1,739,144 | 12/1929 | Huntworth | 362/280 |
| 2,078,028 | 4/1937 | Schneider | 362/187 |
| 4,190,880 | 2/1980 | Esaki | 362/281 |
| 4,530,039 | 7/1985 | Shin-Shi | 362/280 |
| 5,083,253 | 1/1992 | Hahnel | 362/280 |

FOREIGN PATENT DOCUMENTS

| | | |
|---|---|---|
| 25 09 270 | 9/1976 | Germany . |
| 612 490 | 7/1979 | Switzerland . |
| 1146426 | 3/1969 | United Kingdom . |

*Primary Examiner*—Alan Cariaso
*Attorney, Agent, or Firm*—Young & Thompson

[57] ABSTRACT

A lamp with an adjustable shade for regulating the dispersion of a light beam, wherein there is mounted on to a wall fitting (1) a tube (2), the front edge of which forms a connecting piece (3) with a second tube (4), on to the free end of which is mounted a light source holder (5) and a light reflector (6), wherein the lamp has a shade (7, 10) and wherein the shade (7, 10) is movable in relation to the second tube (4), the light source holder (5) and the light reflector (6). The external shade part (7) is provided along one section with a longitudinal slot (8) where the shade (7, 10) can be moved along the length of the slot (8) in slidable engagement with the second tube (4). The shade (7, 10) consists of an external shade part (7) and an internal shade part (10), where the external shade part (7) has longer axial extension than the internal shade part (10), and where a slide block (13) constitutes a part and extension of an end wall (11) on the internal shade part (10). The shade (7, 10) is slidable along the length of the slot (8) through the hole (12) in the end wall in the internal shade part (10). Over a first section of its length the external shade part (7) is provided with the slot (8) and over a second section encloses the internal shade part (10).

2 Claims, 1 Drawing Sheet

LAMP WITH ADJUSTABLE SHADE FOR REGULATION OF BEAM

FIELD OF THE INVENTION

The invention concerns a lamp with an adjustable shade for regulating the dispersion of a light beam. The lamp comprises a light source and a reflector mounted in a shade with an aperture and can be used as a work lamp, reading lamp, bedside lamp, standard lamp, wall lamp or in any other way in which until now, if a change is required in the light dispersion at one point at a certain distance, it has been necessary to either move the lamp or the object which has to be illuminated.

For people who sleep in a double bed or in separate beds with more than one bed in the same room, for example, a problem arises when one person wishes to read in bed while the other wants to sleep without being kept awake by light in the room. Tests on the lamp have shown that it is highly suitable for this purpose, as well as being easy to use. In to-day's market there are no lamps which solve this problem in a satisfactory manner.

BACKGROUND OF THE INVENTION

Attempts have been made previously to produce lamps in order to solve this problem, see DE-2509 270, SE-389 385 and GB-1146426. Compared with the present solution the lamp in DE-2509 270 appears to be considerably more cumbersome to adjust as well as being much more expensive to produce. SE-389 385 appears to present a solution with a substantially greater scope and seems more complicated and thereby more expensive to produce than the present lamp and furthermore it will have a higher power consumption and an extremely unattractive appearance in a focused position. In addition the brightness of this lamp will vary according to the position of the reflector in relation to the light source. The invention in GB-1146426 seems more complicated and more expensive to produce and unsuitable for most of the areas of application of the present solution.

SUMMARY OF THE INVENTION

The object of the present invention is to produce a lamp which, apart from being able to be used as an ordinary work lamp, reading lamp, bedside lamp, standard lamp, wall lamp, table lamp, etc. with normal light dispersion, also permits a point or a spot to be illuminated at a certain distance from the light source without the need to move the lamp or the object which has to be illuminated. The lamp is designed in such a manner that when it is in a focused position it gives very good spot lighting with little light dispersion. When used as bedside lighting, when the lamp is set in the focused position, the rest of the room is shielded from the light, thereby causing only a very slight degree of dazzle. Furthermore the lamp should be simple and inexpensive to produce. The object of the invention is achieved with a lamp which has the characteristic features which are indicated in the patent claims.

BRIEF DESCRIPTION OF THE DRAWINGS

The invention will now be described in more detail with reference to the attached schematic drawings which illustrate one of many conceivable embodiments of the invention.

DETAILED DESCRIPTION OF THE INVENTION

Figure 1:
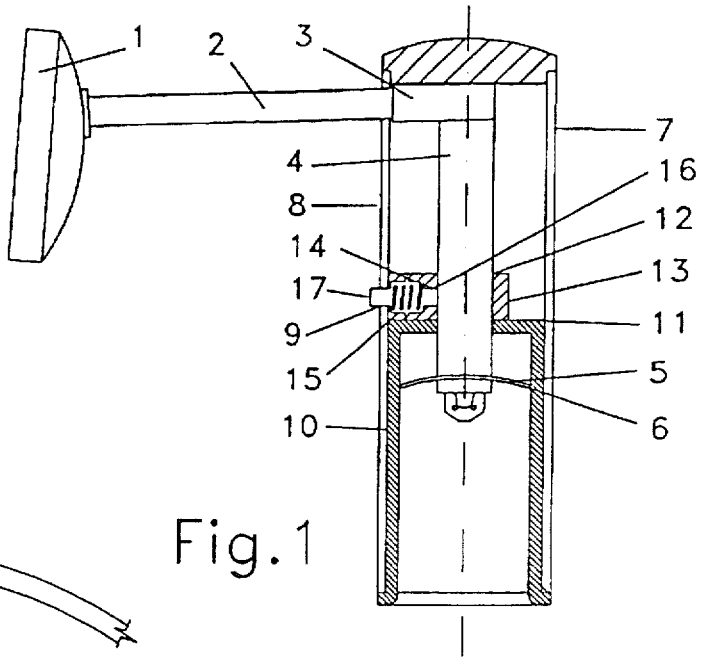
FIG. 1 is a longitudinal section of the lamp in focused position.
Figure 4:
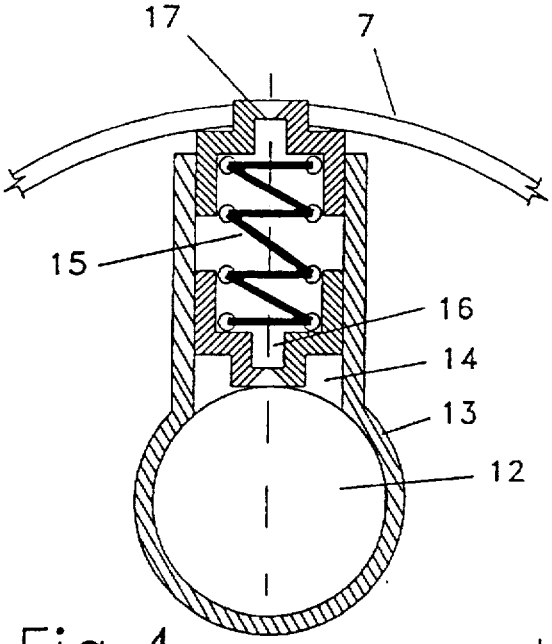
FIG. 4 is a sectional illustration of the stepless adjustment of the slide block.
Figure 2:
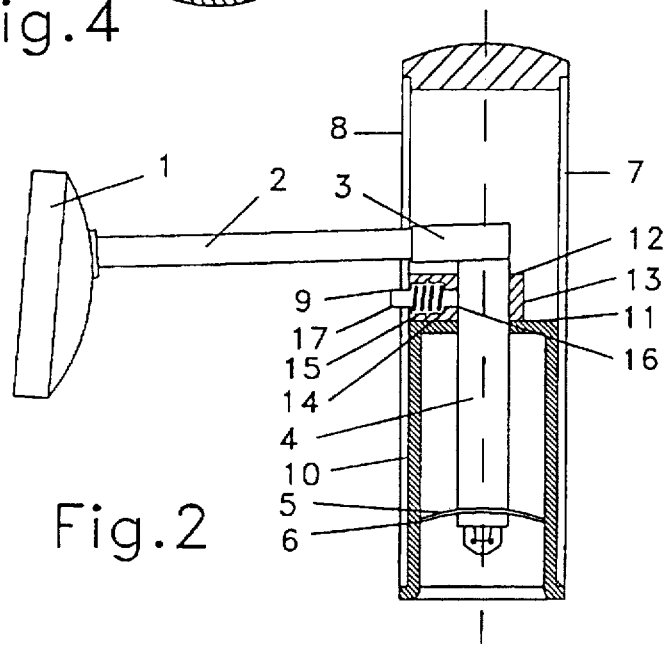
FIG. 2 is a longitudinal section of the lamp in the position for maximum dispersion of the light.
Figure 3:
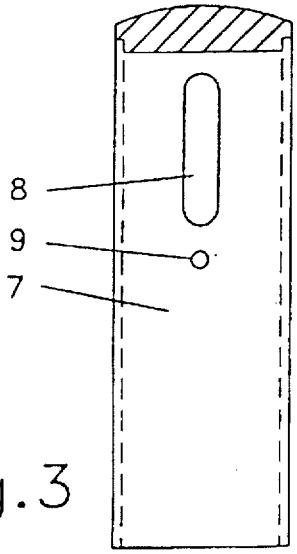
FIG. 3 is a longitudinal section of the external shade part.

On to any kind of fitting, in this case a wall fitting 1, as illustrated in FIGS. 1 and 2, there is mounted a tube 2, on to the front edge of which is mounted a connecting piece 3. This connecting piece 3 is further connected to a second tube 4, on to the front edge of which is mounted a light source holder 5 and a reflector 6. The shade 7 is cylindrical in shape with a slot 8 and in front of the slot a hole 9, and an internal cylindrical part 10, in the rear edge of which is an end wall 11 with a hole 12 through which the tube 4 is passed. The end wall 11 has an extended rear piece, a slide block 13, with a hole 14 for mounting a spring 15, one end of which is enclosed by a sliding plate 16 which is pressed against the second tube 4 and the other end is enclosed by an end piece 17 for anchoring the internal shade part 10, the end piece 17 having a section which is caused to engage with the hole 9 in the external shade part 7. The shade 7, 10 is thereby movable and can be adjusted backwards and forwards along the length of the slot 8, sliding on the tube 4, for the desired length. In the extended position the shade will thereby concentrate the light beam, while retracting the shade 7 will gradually and steplessly disperse the light more and more. FIG. 1 shows the lamp in the focused position, while FIG. 2 shows the lamp in a position with maximum dispersal. FIG. 3 illustrates the position of the slot 8 and the hole 9 on the underside of the external shade 7. FIG. 4 illustrates the stepless adjustment in the slide block 13 where a spring 15, a sliding plate 16 and an end piece 17 are mounted in the hole 14, where one end of the spring is enclosed by the sliding plate 16 and the other end is enclosed by the end piece 17. Thus the spring forces the sliding plate 16 against the second tube 4 and simultaneously anchors the end piece 17, and thereby also the internal shade 10 to the external shade 7 through the hole 9.

The present invention is not limited to the embodiment described and illustrated in the drawing, but can be altered and modified in many different ways within the scope of the patent claims.

As an alternative, the shade parts 7 and 10 can be produced in one connected piece.

What is claimed is:

1. A lamp for regulating the dispersion of a light beam, comprising:

a first tube having a rear edge for mounting on to a fitting, and a front edge;

a connecting piece having a first end mounted on to the front edge, and a second end;

a second tube having a rear end connected to the second end, and a front end;

a light source holder and a reflector mounted on to the front end;

an adjustable shade movable in relation to the second tube, the light source, and the reflector;

said shade being comprised of an external part which encloses an internal part, the external part having a longer axial extension than the internal part;

said external part having along one section a longitudinal slot for moving the shade along the length of the slot in slidable engagement with the second tube;

said internal part having a rear end wall with a hole for passing the second tube therethrough;

a slide block constituting a part and an extension of the end wall;

whereby through the hole in the end wall the shade can slide along the length of the slot.

2. A lamp according to claim 1, further comprising a spring mounted in a hole in the slide block, said spring having a first end and closed by a sliding plate which is pressed against the second tube, and a second end enclosed by an end piece for anchoring the internal part in the external part, the end piece having a second which is caused to engage with an opening in the external shade part for making the lamp steplessly adjustable.

* * * * *